United States Patent [19]

Wright

[11] Patent Number: 4,986,435

[45] Date of Patent: Jan. 22, 1991

[54] RECEPTACLE FOR A FLEXIBLE BEVERAGE CONTAINER

[76] Inventor: Connie Wright, 11606 Shady Grove, Houston, Tex. 77024

[21] Appl. No.: 364,885

[22] Filed: Jun. 12, 1989

[51] Int. Cl.[5] ..... B65D 21/02

[52] U.S. Cl. ..... 220/85 H; 220/338

[58] Field of Search ..... 220/307, 338, 85 H, 220/17

[56] References Cited

U.S. PATENT DOCUMENTS

| | | | |
|---|---|---|---|
| 2,504,850 | 4/1950 | Lermer | 220/307 |
| 2,765,949 | 10/1956 | Hillman | 220/338 |
| 3,612,335 | 10/1971 | Schurman | 220/338 |
| 4,220,253 | 9/1980 | Thomas et al. | 220/338 |
| 4,437,575 | 3/1984 | Hahn | 220/1 T |
| 4,646,961 | 3/1987 | Wald | 220/85 H |
| 4,771,911 | 9/1988 | Morony et al. | 220/85 H |
| 4,782,945 | 11/1988 | Geiler | 220/85 H |
| 4,796,937 | 1/1989 | Andrea | 220/85 H |

*Primary Examiner*—Joseph Man-Fu Moy

*Attorney, Agent, or Firm*—Vinson & Elkins

[57] ABSTRACT

A specialized receptacle for receiving and for holding a fluid filled, box-style beverage container, the beverage container having flexible walls and a foil covered access port positioned on a top portion of the beverage container. The receptacle includes four planar sidewalls each integrally connected to an adjacent one of the planar sidewalls and a bottom integrally connected to at least one of the sidewalls. The combination of four planar sidewalls and bottom collectively defines a box-like structure having an internal space, and having an opening for receiving and for holding the fluid filled, box-style beverage container within the internal space. The receptacle may include handles or grooves to improve grasping; may include a hole in the bottom portion of the receptacle to facilitate removal of a beverage container; may include a top piece used to retain the beverage container in the internal space of the receptacle; and may include insulative means to insure a cool beverage product. The top piece may be attached by pivot means, by snap closure means, or by sliding means.

17 Claims, 3 Drawing Sheets

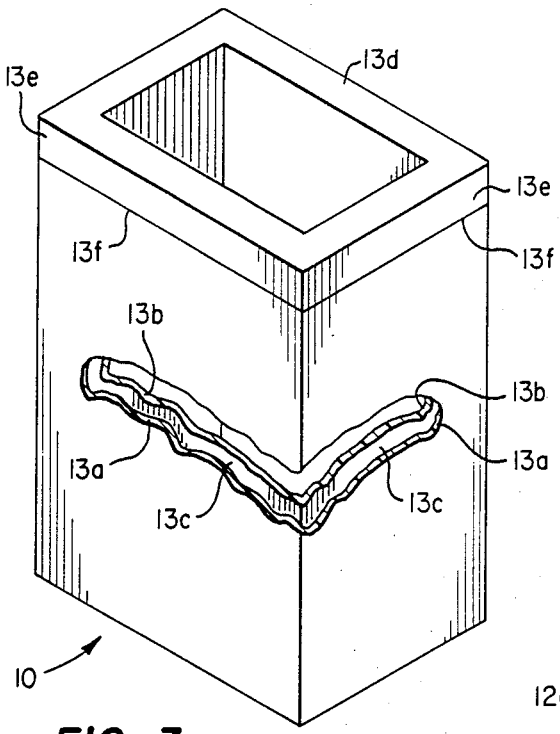
FIG. 3
FIG. 4
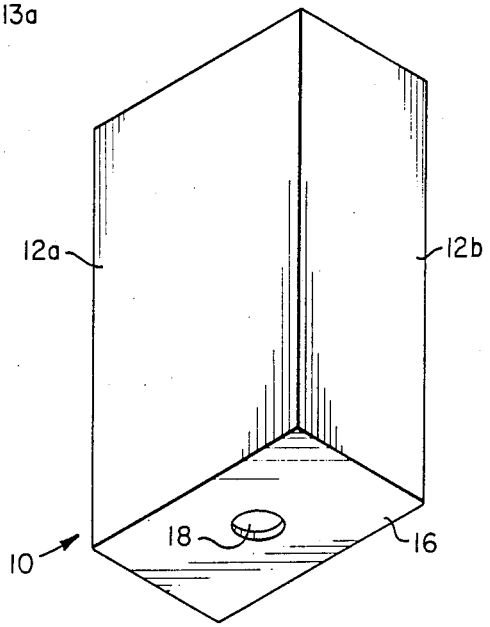
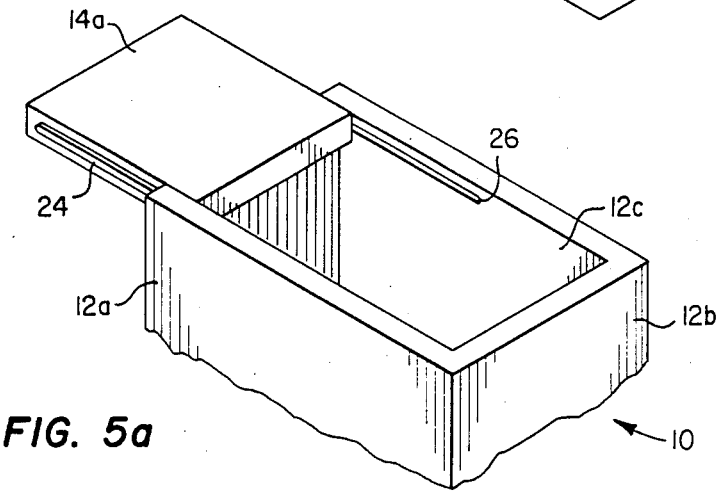
FIG. 5a

RECEPTACLE FOR A FLEXIBLE BEVERAGE CONTAINER

FIELD OF THE INVENTION

This invention is directed to a specialized, hand-held receptacle having rigid walls defining an interior space for housing in a non-crushing, non-deflating manner a flexible beverage container, or juice box, of the "Tetra-Pak" style, that is, a beverage container or juice box of a substantially rectangular, box-shape having flexible sidewalls and a pierceable, foil sealed, access port on its top.

BACKGROUND OF THE INVENTION

Many styles of containers may be selected to be used to transport and to store non-carbonated beverages including juice drinks and associated products such as super pasteurized milk products. Examples of such containers include containers composed of glass, of plastic, or of paraffin coated paper products. One container product which has gained wide consumer acceptance comprises a substantially rectangular, box-shaped paper container having flexible sidewalls and a pierceable, foil sealed access port on its top. The access port generally is located substantially in a corner portion of the top of the box and is approximately one-eighth to one-quarter of an inch in diameter. The foil seal functions as an closure and as a means to maintain a sterile fluid product, but is capable of being punctured easily through piercing with a selected pointed end of a plastic drinking straw. One such juice box container is marketed under the name "Tetra-Pak." See, for example, United States Letters Patent No. 4,287,247, incorporated herein by reference.

When accessing the interior of the beverage container, the pointed end of a plastic drinking straw (such straw is generally provided attached by a securement means, such as glue or adhesive tape, to the exterior of the beverage container) is placed against the foil seal located on the top of the beverage container and pressure is exerted until the straw pierces the seal and becomes immersed in the liquid contained within the beverage container. The foil seal, although pierced, nevertheless maintains a fairly secure seal about the sidewall of the drinking straw.

This style of beverage container is attractive because it is easily manipulated by small children, can be carried in school lunch boxes, and is disposable, among other reasons. Nevertheless, several problems are associated with beverage containers of the "Tetra-Pak" style. Most importantly, the juice box container has very flexible sidewalls; the sidewalls generally are constructed of a paper product. After the drinking straw has been inserted through the foil seal and immersed within the fluid contained within the beverage container, the fluid may be expelled easily through the drinking straw by exerting pressure on the sidewalls of the beverage container through squeezing. With even slight pressure, fluid is transported through the drinking straw and is discharged in a stream from the exposed end of the drinking straw. Unfortunately, many small children do not comprehend that pressure exerted on the exterior sidewalls of the container will result in an unwanted puddle of liquid; those that do comprehend, much to the dismay of some adults, sometimes delight in their new found toy and its garden-hose like qualities.

With these problems in mind, the present invention is a receptacle for housing a juice box container and for prohibiting the discharge of juice or other fluid from a drinking straw by squeezing the sidewalls of the juice box container.

SUMMARY OF THE INVENTION

The present invention is a rigid receptacle having an interior space for housing a substantially rectangular boxshaped beverage container having flexible sidewalls and a pierceable, foil sealed access port located in a selected portion of its top. The receptacle is constructed of rigid plastics material and may be either of single or double wall construction. When double wall construction is used, the space between the sidewalls functions as a dead air space which, in turn, provides insulation for the cool fluid contained in the beverage container when deposited within the receptacle. Moreover, the air space present when double wall construction is used, may be filled with an insulative material, such as a foamed plastics material for example.

The receptacle may have a movably secured cap piece which covers a portion of the top of the beverage container and secures the beverage container within the interior space defined by the sidewalls and bottom of the receptacle. The cap piece, for example, may be a sliding member or a pivoting member, and, for example, may snap into place to secure the juice box within the interior space defined by the receptacle. The receptacle may have at least one handle, such as substantially ring shaped handle, attached to an exterior side portion of the receptacle. Also, the receptacle may have a series of grooves carried in one or more exterior sidewalls of the receptacle, which grooves act to enhance the grip of the consumer about the receptacle. Further, the receptacle may contain a hole in its bottom portion to facilitate easy extraction of the beverage container from the interior portion of the receptacle, and may contain aesthetically pleasing designs or other indicia on the exterior of the receptacle.

One object of this invention is to provide a specialized, hand-held, rigid receptacle for holding a flexible beverage container, or juice box, in a manner that will prohibit unwanted pressure from being exerted on the exterior sidewalls of the beverage container resulting in unwanted discharge of the fluid contained within the beverage container.

Another object of the invention is to provide a receptacle for a flexible beverage container wherein the receptacle has a cap to ensure that the beverage container will remain within the interior space defined by the sidewalls and bottom of the receptacle.

Another object of this invention is to provide a receptacle having means for the consumer to grasp the receptacle; such means for grasping are exemplified by at least one handle attached to the exterior of the receptacle, and by a grooved pattern in the exterior sidewall of the receptacle.

A further object of the invention is to provide a receptacle comprising a plastics material which is light in weight and which permits inexpensive manufacturing.

A further object of this invention is to provide a receptacle comprising insulation which insulation functions to keep the contents of the beverage container either hot or cool.

DESCRIPTION OF THE DRAWINGS

FIG. 3 is a partial sectional view in perspective of the receptacle of the present invention illustrating a double wall construction with insulation.

FIG. 4 is a perspective view of the bottom of the receptacle illustrating an opening which allows ejection of a beverage container which becomes lodged within the receptacle.

FIG. 5*a* is a perspective view of a top of the receptacle illustrating a sliding cover used to retain a beverage container within the receptacle.

DETAILED DESCRIPTION OF THE INVENTION

Figure 1:
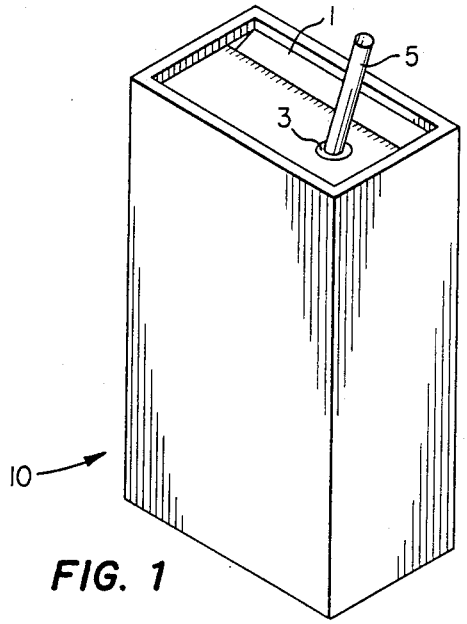
FIG. 1 is a perspective view of the receptacle of the present invention illustrating a beverage container housed with the interior space defined by the sidewalls of the receptacle.

The receptacle is designated as 10 and is composed of an inexpensive, lightweight material such as plastic. Receptacle 10 comprises four rigid walls designated 12*a*, 12*b*, 12*c* and 12*d*; a top 14 such as 14*a*, 14*b*, 14*c* or 14*d*; and a bottom 16. The bottom 16 and four walls define an interior space for receiving and for holding in a noncrushing, non-deflating manner a flexible beverage container 1 of the "Tetra-Pak" style. A "Tetra-Pak" style container is a substantially rectangular box-shaped container having flexible sidewalls and a pierceable, foil sealed access port 3 on its top. Generally, a drinking straw 5 accompanies the "Tetra-Pak" style container and is used to pierce the foil sealed access port 3.

Receptacle 10 may have one or more handles 20 capable of being grasped by a small child such as a toddler, or it may have one or more grooves 22 on the eternal sidewall which serve to improve the grip exerted, for example, by small children such as toddlers. Further, receptacle 10 may include an opening 18 on the bottom 16 of the receptacle 10; opening 18 allows ejection or extraction of a beverage container which becomes lodged within the interior space of receptacle 10.

Figure 2A:
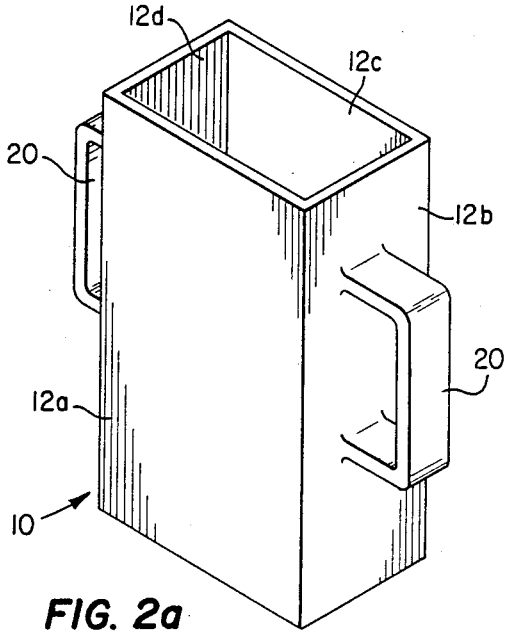
FIG. 2*a* is a perspective view of the receptacle of the present invention illustrating handles provided to allow, for example, small children to hold the receptacle.
Figure 2B:
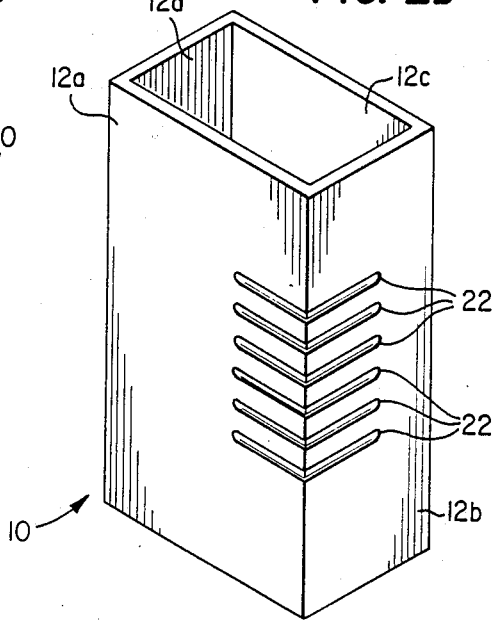
FIG. 2*b* is a perspective view of the receptacle of the present invention illustrating grooves on the external sidewall, provided to allow, for example, small children to grip the exterior of the receptacle.
Figure 5B:
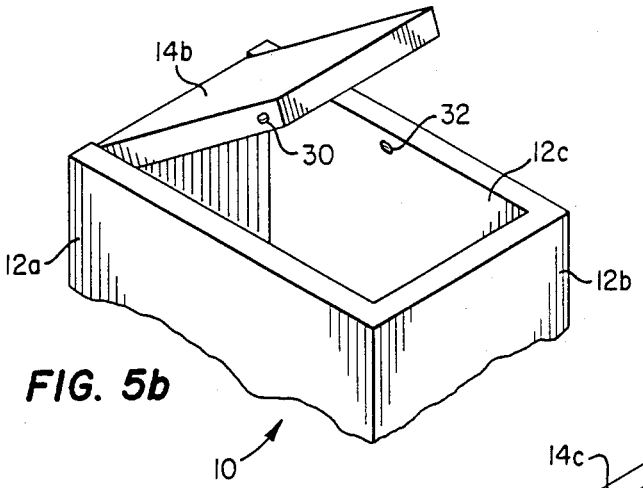
FIG. 5*b* is a perspective view of a top of the receptacle illustrating a pivoting cover which snaps closed.
Figure 5C:
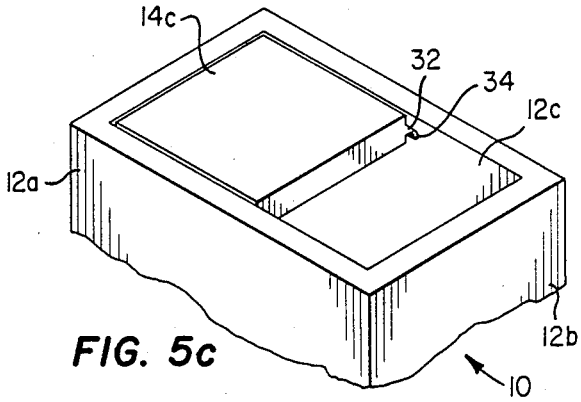
FIG. 5*c* is a perspective view of a top of the receptacle illustrating a snap closure which can be removably secured to the receptacle.
Figure 5D:
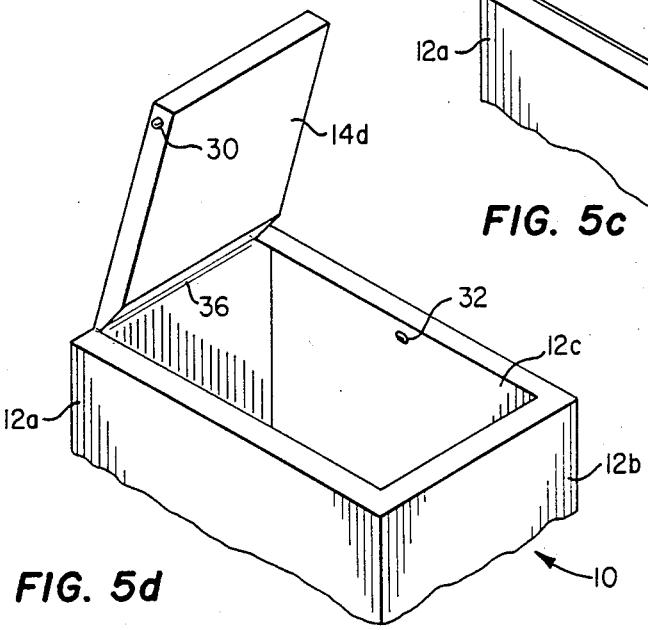
FIG. 5*d* is a perspective view of a top of the receptacle illustrating a pivoting cover connected to the receptacle by a thin web of plastic material, and illustrating a snap closure.
Figure 5E:
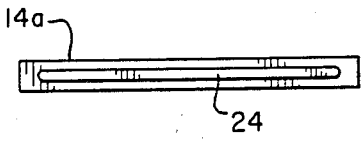
FIG. 5*e* is a side view of a top of the receptacle showing an elongated, outwardly extending flange.
Figure 5F:
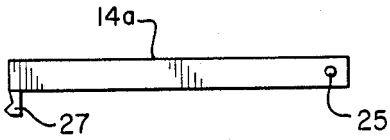
FIG. 5*f* is a side view of a top of the receptacle showing an outwardly extending protuberance on one end of the top and a portion of a snap closure.

Receptacle 10 may be constructed as single walled receptacle as shown, for example, in FIGS. 1, 2*a* or 2*b*. Likewise, receptacle 10 may be constructed as a double walled receptacle as shown in FIG. 3. The double wall construction shown in FIG. 3 is illustrated by use of outer wall 13*a* and inner wall 13*b* secured in spaced relationship so as to provide an air space 13*c*. Air space 13*c* functions as an insulative means when the top and bottom of receptacle 10 are closed so that ambient air cannot flow freely from the outside of the receptacle into the air space and out again.

Air space 13*c* can be formed by creating an outer shell comprising exterior sidewall 13*a*, by creating an inner shell comprising interior sidewall 13*b* fashioned as a cup and designed to be inserted within the outer shell, and by inserting the inner shell within the outer shell. Inner shell 13*b* includes an outwardly and downwardly turning lip 13*d* having an outer edge 13*e* designed to sealingly mate with the upper edge 13*f* of the outer shell. In this construction, the bottom of the inner shell does not contact the inside, bottom portion of the outer shell; this helps to maintain the receptacle's insulative properties. In another construction, a unitary outer wall and inner wall may be molded, for example, of plastic; the longitudinal cross-sectional shape of each of the sidewalls shows a monolithic U-shaped construction comprising parallel inner and outer walls; a bottom positioned substantially perpendicularly to and integrally joined with, each of the inner walls; and a unitary distal edge portion defined by each outer sidewall extending further downwardly and in the longitudinal direction than each corresponding inner wall portion. This extension allows for a bottom portion to be sealingly attached to the distal edge portion thereby defining an interior air space having insulative qualities. It should be noted that in any receptacle 10 having an insulative air space defined by inner and outer walls, a foamed plastics material may be introduced into the air space to increase the insulative properties of the receptacle 10.

Receptacle 10 includes a top such as 14*a*, 14*b*, 14*c* or 14*d*, which, when in its closed position, secures a beverage container, such as juice box 1, within the receptacle 10 in the interior space defined by walls 12*a*, 12*b*, 12*c* and 12*d*. One top comprises a rectangular piece of material, such as plastic, having two outwardly extending flanges 24, each matingly received and in sliding contact with a respective groove 26 carried in one of the respective sidewalls 12*a* and 12*c* of the receptacle. The grooves may be extended to the edge of the receptacle and open outwardly allowing the flanges 24 carried on top 14*a* to be slipped into respective grooves 26. In the alternative, each of the flanges may be an outwardly extending post 25 riding in an alternative groove (not shown) which groove does not open outwardly along its longitudinal axis. The alternative groove, thus, retains the post within the groove allowing the top 14*a* to slide alternatively to an open or to a closed position. A snap closure such as 27 may be included on the end portion of the top opposite the end portion bearing the posts 25. Such a snap, for example, extends downwardly and slightly outwardly and cooperates by matingly engaging an aperture on the interior of an adjacent sidewall when the top is in its closed position.

A second top 14*b* comprises a rectangular piece of material, such as plastic, having a pivot pin (not shown) extending from each of two opposite sides of the top 14*b*, each pivot pin (not shown) being pivotally secured within a respective aperture (not shown) located in a respective internal sidewall 12*a* and 12*c* of the receptacle 10. Two separate pivot pins may be employed instead of a single pivot pin; if two are employed, the longitudinal axis of one is aligned with the longitudinal axis of the other. The second top 14*b*, on its opposite end portion bears two protuberances 30 which each extend from a respective one of two opposite sides of top 14*b*. Each protuberances 30 comprises a portion of a snap closure; each protuberance 30 cooperates in snapping fashion with a respective aperture 32 carried in one of the sidewalls; the respective aperture 32 comprises the other portion of the snap closure. The snap closure comprises two protuberances 30 cooperating with two respective apertures 32, for example.

A third top 14*c* comprises a rectangular piece of material, such as plastic, having two outwardly extending flange-like portions 32 each matingly received in a respective groove 34 carried on the interior of one of the respective sidewalls of the receptacle. Top 14*c* is a snap closure; it may be snapped into place by positioning the flanges 32 of top 14*c* substantially adjacent respective grooves 34, and pressing top 14*c* toward receptacle 10 to achieve a snap fit, wherein grooves 34 engage flanges 32 to achieve securement.

A fourth top 14*d* comprises a rectangular piece of plastic material, having a pivoting edge portion positioned at one end of the top and connected via a thin pliable plastic web 36 to one of the planar sidewalls of the receptacle or, in the alternative, to an upper edge portion of the receptacle. The thin web 36 acts as a hinge and secures the top to the sidewall or, in the alternative, to an upper edge portion, and can be easily molded of a plastics material. Accordingly the top and sidewall or, in the alternative, the upper edge portion, form a monolithic structure. Top 14*d*, on its opposite end portion bears two protuberances 30 which each extend from a respective one of two opposite sides of top 14*b*. Each protuberance 30 comprises a portion of a snap closure; each protuberance 30 cooperates in a snapping fashion with a respective aperture 32 carried in one of the sidewall 12*a* and 12*c*; the respective aperture 32 comprises the other portion of the snap closure. The snap closure comprises two protuberances 30 cooperating with two respective apertures 32, for example.

It should be noted that each top does not cover the entire top surface of the beverage container; such positioning leaves the foil covered access port 3 open to receive drinking straw 5 of beverage container 1. The top or cap (e.g., 14*a*, 14*b*, 14*c* or 14*d*) preferably covers no more than two-thirds of the top portion of beverage container 1; this ensures that a portion of the top portion of beverage container 1 carrying the access port 3 will not be covered or otherwise blocked; such blockage would prohibit access to the foil sealed port. In addition it is recognized that any one of the tops (e.g., 14*a*, 14*b*, 14*c* or 14*d*) could be positioned and, for example, hinged or otherwise coupled with any combination of the four planar sidewalls.

I claim:

1. A receptacle for holding a beverage container, said beverage container having flexible walls and an access port positioned on a top portion of said beverage container, and for shielding said flexible wall container from unwanted pressure exerted on said flexible walls resulting in the expulsion of said fluid from said flexible wall container through a portion of said access port, said receptacle comprising:

a plurality of rigid sidewalls each connected to an adjacent one of said sidewalls;

a bottom connected to at least one of said sidewalls, said sidewalls and said bottom collectively defining a box-like structure having an internal space therein, said structure having an opening for receiving said beverage container;

and a top piece covering a portion of said opening and cooperating with said sidewalls to secure said beverage container within said internal space, wherein a portion of said opening not covered by said top piece corresponds to the location of said access port of said beverage container when said beverage container is secured within said internal space.

2. The receptacle of claim 1 wherein said receptacle is of closed double wall construction, said construction comprising an interior wall and an exterior wall defining an air space having insulative qualities.

3. The receptacle of claim 2 wherein said top piece comprises a substantially rectangularly shaped cover having a first protuberance and a second protuberance, said first protuberance protruding from a first edge and said second protuberance protruding from a second and opposite edge; and wherein said receptacle comprises a first aperture and a second aperture, said first aperture being located interiorly within said internal space and on a first sidewall and said second aperture being located interiorly within said internal space and on a second and opposite sidewall, said first aperture being positioned to receive in mating fashion said first protuberance and said second aperture being positioned to receive in mating fashion said second protuberance.

4. The receptacle of claim 3 wherein said cover utilizes a snap closure to secure said cover in place on said receptacle when said first and said second protuberance and said first and said second aperture are arranged in mating fashion.

5. The receptacle of claim 4 wherein said first protuberance and said second protuberance are located on opposite edges of one end of said top, and said top includes a hinge located on an opposite end of said top, said hinge cooperating with one of said sidewalls.

6. The receptacle of claim 5 wherein said hinge comprises a pivot pin cooperating with a socket on one of said planar sidewalls.

7. The receptacle of claim 1 in combination with a rectangular, box-shaped beverage container.

8. The receptacle of claim 7 wherein said receptacle is closed double wall construction, said construction comprising an interior wall and an exterior wall defining an air space having insulative qualities.

9. The receptacle of claim 8 wherein said sidewalls are substantially planar;

wherein said to piece comprises a substantially rectangular shaped cover having a first protuberance and a second protuberance, said first protuberance protruding from a first edge and said second protuberance protruding from a second and opposite edge; and wherein said receptacle comprises a first aperture and a second aperture, said first aperture being located interiorly within said internal space and on a first planar sidewall and said second aperture being located interiorly within said internal space and on a second and opposite planar sidewall, said first aperture being positioned to receive in mating fashion said first protuberance and said second aperture being positioned to receive in mating fashion said second protuberance.

10. The receptacle of claim 9 wherein said cover utilizes a snap closure to secure said cover in place on said receptacle when said first and said second protuberance and said first and said second aperture are arranged in mating fashion.

11. The receptacle of claim 10 wherein said first aperture and said second aperture are each grooves, and said first protuberance and said second protuberance slide in mating fashion within said respective grooves.

12. The receptacle of claim 10 wherein said first protuberance and said second protuberance are located on opposite edges of one end of said top, and said top includes a hinge located on an opposite end of said top, said hinge cooperating with one of said planar sidewalls.

13. The receptacle of claim 12 wherein said hinge comprises a pivot pin cooperating with a socket on one of said planar sidewalls.

14. The receptacle of claim 2 wherein said air space is filled with insulative material.

15. The receptacle of claim 8 wherein said air space is filled with insulative material.

16. The receptacle of claim 1, further comprising means, attached to a sidewall of said box-like structure, for facilitating grasping said box-like structure.

17. The receptacle of claim 7, further comprising means, attached to a sidewall of said box-like structure, for facilitating grasping said box-like structure.

* * * * *

US004986435B1

REEXAMINATION CERTIFICATE (2283rd)

United States Patent [19]

Wright

[11] B1 4,986,435

[45] Certificate Issued Apr. 26, 1994

[54] RECEPTICLE FOR A FLEXIBLE BEVERIDGE CONTAINER

[76] Inventor: Connie Wright, 11606 Shady Grove, Houston, Tex. 77024

Reexamination Request:
No. 90/002,631, Feb. 4, 1992

Reexamination Certificate for:

| | |
|---|---|
| Patent No.: | **4,986,435** |
| Issued: | **Jan. 22, 1991** |
| Appl. No.: | **364,885** |
| Filed: | **Jun. 12, 1989** |

[51] Int. Cl.[5] ..... B65D 21/02

[52] U.S. Cl. ..... 220/737; 220/338; D7/619

[58] Field of Search ..... 220/408, 409, 410, 411, 220/412, 413, 420, 425, 256, 259, 338, 339, 345, 346, 347, 737, 739, 740, 903, 703, 705, 709, 710, 711, 713, 906; 215/12.1, 100 R; 229/1.5 H, 125.08, 125.12

[56] References Cited

U.S. PATENT DOCUMENTS

| | | | |
|---|---|---|---|
| 2,450,244 | 9/1948 | Lynch | 220/906 X |
| 2,457,966 | 1/1949 | Zaidan | 220/259 X |
| 2,932,423 | 4/1960 | Baumgartner | 220/737 |
| 2,936,927 | 5/1960 | Peters | 220/737 |
| 3,078,026 | 2/1963 | Meinecke et al. | 220/410 X |
| 3,167,104 | 1/1965 | Wiley et al. | 229/125.08 X |
| 3,223,275 | 12/1965 | Rice, Jr. . | |
| 3,420,367 | 1/1969 | Carmichael | 220/906 X |
| 3,527,373 | 9/1970 | Giraudet et al. | 220/345 |
| 3,759,203 | 9/1973 | Frankenberg | 220/906 X |
| 3,861,523 | 1/1975 | Fountain et al. | 220/259 X |
| 3,905,511 | 9/1975 | Groendal | 220/739 |
| 4,163,374 | 8/1979 | Moore et al. | 220/737 X |
| 4,194,627 | 3/1980 | Christensen | 220/412 X |
| 4,232,532 | 11/1980 | Marsh | 220/412 X |
| 4,299,100 | 11/1981 | Crisman et al. | 220/903 X |
| 4,538,731 | 9/1985 | Cillario | 220/339 X |
| 4,600,111 | 7/1986 | Brown | 220/737 X |
| 4,615,463 | 10/1986 | Price et al. | 220/412 |
| 4,919,296 | 4/1990 | Kirsh et al. | 220/737 |
| 4,974,741 | 12/1990 | Gustafson et al. | 220/739 |
| 4,974,744 | 12/1990 | Shanklin et al. | 220/278 |
| 5,052,575 | 10/1991 | Raureby | 220/278 |
| 5,105,976 | 4/1992 | Patterson | 220/711 |

*Primary Examiner*—Allan N. Shoap

[57] ABSTRACT

A specialized receptacle for receiving and for holding a fluid filled, box-style beverage container, the beverage container having flexible walls and a foil covered access port positioned on a top portion of the beverage container. The receptacle includes four planar sidewalls each integrally connected to an adjacent one of the planar sidewalls and a bottom integrally connected to at least one of the sidewalls. The combination of four planar sidewalls and bottom collectively defines a box-like structure having an internal space, and having an opening for receiving and for holding the fluid filled, box-style beverage container within the internal space. The receptacle may include handles or grooves to improve grasping; may include a hole in the bottom portion of the receptacle to facilitate removal of a beverage container; may include a top piece used to retain the beverage container in the internal space of the receptacle; and may include insulative means to insure a cool beverage product. The top piece may be attached by pivot means by, snap closure means, or by sliding means.

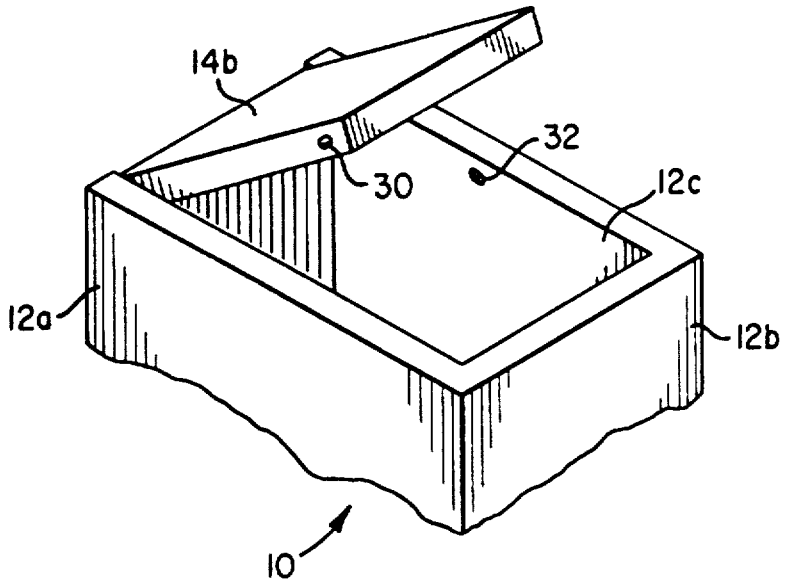

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3 and 9 are cancelled.

Claims 2, 4, 7, 8, 10–12 and 14–17 are determined to be patentable as amended.

Claims 5, 6 and 13, dependent on an amended claim, are determined to be patentable.

New claims 18–32 are added and determined to be patentable.

2. The [receptacle] *combination* of claim [1] *20* wherein said receptacle is of closed double wall construction, said construction comprising an interior wall and an exterior wall defining an air space having insulative qualities.

4. The receptacle of claim [3] *22* wherein said cover utilizes a snap closure to secure said cover in place on said receptacle when said first and said second protuberance and said first and said second aperture are arranged in mating fashion.

7. The [receptacle of claim 1 in] combination [with a] *of claim 20 wherein said receptacle is a* rectangular, box-shaped beverage container.

8. The [receptacle] *combination* of claim 7 wherein said receptacle is closed double wall construction, said construction comprising an interior wall and an exterior wall defining an air space having insulative qualities.

10. The [receptacle] *combination* of claim [9] *20* wherein said cover utilizes a snap closure to secure said cover in place on said receptacle when said first and said second protuberance and said first and said second aperture are arranged in mating fashion.

11. The [receptacle] *combination* of claim 10 wherein said first aperture and said second aperture are each grooves, and said first protuberance and said second protuberance slide in mating fashion within said respective grooves.

12. The receptacle of claim 10 wherein said first protuberance and said second protuberance are located on opposite edges of one end of said top *piece*, and said top *piece* includes a hinge located on an opposite end of said top *piece*, said hinge cooperating with one of said planar sidewalls.

14. The [receptacle] *combination* of claim 2 wherein said air space is filled with insulative material.

15. The [receptacle] *combination* of claim 8 wherein said air space is filled with insulative material.

16. The [receptacle] *combination* of claim [1] *20*, further comprising means, attached to a sidewall of said box-like structure, for facilitating grasping said box-like structure.

17. The [receptacle] *combination* of claim 7, further comprising means, attached to a sidewall of said box-like structure, for facilitating grasping said box-like structure.

*18. The combination comprising a fluid holding potable beverage container having flexible walls and an access port positioned on a top portion of the beverage container and through which the beverage is easily expelled when pressure is applied to the flexible side walls, and a receptacle removably holding said container and including a plurality of rigid side walls each connected to an adjacent one of said side walls for resisting said pressure and thereby preventing the expelling of the beverage;*

*a bottom connected to at least one of said side walls, said side walls and said bottom collectively defining a box-like structure having an internal space therein, said structure having an opening for receiving the beverage container and said beverage container resting directly upon said bottom wall, and said bottom and said side walls combine to shield the flexible wall container from unwanted pressure exerted upon the flexible walls resulting in the expulsion of the beverage from the flexible wall container through the beverage container access port;*

*a top piece covering a portion of said structure opening and cooperating with said side walls to secure the beverage container within said internal space, wherein a portion of said structure opening not covered by said top piece corresponds to the location of the access port of the beverage container when the beverage container is secured within said internal space.*

*19. The combination of claim 18, wherein said side walls fully extend about the container leaving exposed the container top.*

*20. The combination comprising a fluid holding potable beverage container of predetermined size and having flexible sidewalls and an access port positioned on a top portion thereof, said container being of the type in which unwanted pressure exerted on said flexible walls results in the expulsion of said fluid from said flexible wall container through said access port; and*

*a receptacle including a plurality of sidewalls each connected to an adjacent one of said receptacle sidewalls;*

*a bottom wall connected to at least one of said sidewalls, said sidewalls and said bottom wall collectively defining a box-like structure having an internal space therein, said structure having an opening for receiving the beverage container and the beverage container resting directly upon said bottom wall; and*

*a top piece covering less than said entire opening and cooperating with said sidewalls to secure said beverage container within said internal space, wherein with said top piece in a closed position a portion of said opening not covered by said top piece corresponds to the location of said access port of the beverage container when the beverage container is secured within said internal space, said receptacle sidewalls being rigid to shield said container flexible walls from unwanted pressure being exerted thereon which would result in the expulsion of said fluid from said flexible wall container through said access port.*

*21. The combination of claim 20, wherein said sidewalls fully extend about the container leaving exposed the container top.*

*22. A receptacle for holding a potable beverage container of predetermined size, the beverage container having flexible side walls and an access port positioned on a top portion of the beverage container, the container being of the type in*

*which unwanted pressure exerted on the flexible walls results in the expulsion of the fluid from the flexible wall container through the access port, said receptacle comprising:*

*a plurality of rigid sidewalls each connected to an adjacent one of said sidewalls for shielding the flexible wall container from the unwanted pressure;*

*a bottom wall connected to at least one of said sidewalls, said sidewalls and said bottom wall collectively defining a box-like structure having an internal space therein, said structure having an opening for receiving the beverage container and the beverage container resting directly upon said bottom wall; and*

*a top piece covering less than said entire opening and cooperating with said sidewalls to secure said beverage container within said internal space, wherein with said top piece in a closed position a portion of said opening not covered by said top piece corresponds to the location of said access port of the beverage container when the beverage container is secured within said internal space, said receptacle having closed double wall construction said construction comprising an interior wall and an exterior wall defining an air space having insulative qualities, said top piece having a substantially rectangularly shaped cover having a first protuberance and a second protuberance, said first protuberance protruding from a first edge and said second protuberance protruding from a second and opposite edge; and*

*said receptacle having a first aperture and a second aperture, said first aperture being located interiorly within said internal space and on a first sidewall and said second aperture being located interiorly within said internal space and on a second and opposite sidewall, said first aperture being positioned to received in mating fashion said first protuberance and said second aperture being positioned to receive in mating fashion said second protuberance.*

*23. A receptacle for holding a potable beverage container of predetermined size, the beverage container having flexible side walls and an access port positioned on a top portion of the beverage container, the container being of the type in which unwanted pressure exerted on the flexible walls results in the expulsion of the fluid from the flexible wall container through the access port, said receptacle comprising:*

*a plurality of rigid sidewalls each connected to an adjacent one of said sidewalls for shielding the flexible wall container from the unwanted pressure;*

*a bottom wall connected to at least one of said sidewalls, said sidewalls and said bottom wall collectively defining a box-like structure having an internal space therein, said structure having an opening for receiving the beverage container and the beverage container resting directly upon said bottom wall; and*

*a top piece covering less than said entire opening and cooperating with said sidewalls to secure said beverage container within said internal space, wherein with said top piece in a closed position a portion of said opening not covered by said top piece corresponds to the location of said access port of the beverage container when the beverage container is secured within said internal space said sidewalls being substantially planar;*

*said top piece being a substantially rectangular shaped cover having a first protuberance and a second protuberance, said first protuberance protruding from a first edge and said second protuberance protruding from a second and opposite edge; and*

*said receptacle having a first aperture and a second aperture, said first aperture being located interiorly within said internal space and on a first sidewall and said second aperture being located interiorly within said internal space and on a second and opposite sidewall, said first aperture being positioned to received in mating fashion said first protuberance and said second aperture being positioned to receive in mating fashion said second protuberance.*

*24. A receptacle for holding a fluid holding portable beverage container, the beverage container having flexible walls and an access port positioned on a top portion of the beverage container and through which the beverage is easily expelled when pressure is applied to the flexible sidewalls, said receptacle comprising:*

*a plurality of rigid sidewalls each connected to an adjacent one of said sidewalls for resisting the pressure and thereby preventing the expelling of the beverage;*

*a bottom connected to at least one of said sidewalls, said sidewalls and said bottom collectively defining a box-like structure having an internal space therein, said structure having an opening for receiving the beverage container and said container resting directly upon said bottom wall and said bottom and said sidewalls combine to shield the flexible wall container from unwanted pressure exerted upon the flexible walls resulting in the expulsion of the beverage from the flexible wall container through the beverage container access port;*

*a top piece covering a portion of said opening and cooperating with said sidewalls to secure the beverage container within said internal space, wherein a portion of said structure opening not covered by said top piece corresponds to the location of the access port of the beverage container when the beverage container is secured within said internal space and wherein said top piece comprises a substantially rectangularly shaped cover having a first protuberance and a second protuberance, said first protuberance protruding from a first edge and said second protuberance projecting from a second and opposite edge of said cover; and*

*a first aperture and a second aperture, said first aperture being located interiorly within said internal space and on a first of said sidewalls and said second aperture being located interiorly within said internal space and on a second of said sidewalls, said second sidewall being opposite said first sidewall, said first aperture being positioned to receive in mating fashion and first protuberance and said second aperture being positioned to receive in mating fashion said second protuberance.*

*25. The combination of claim 24 wherein said cover utilizes a snap closure to secure said cover in place on said receptacle when said first and said second protuberance and said first and said second aperture are arranged in mating fashion.*

*26. The combination of claim 25 wherein said first protuberance and said second protuberance are located on opposite edges of one end of said top, and said top includes a hinge located on an opposite end of said top, said hinge cooperating with one of said sidewalls.*

*27. The combination of claim 26 wherein said hinge comprises a pivot pin cooperating with a socket in one of said planar sidewalls.*

*28. A receptacle for holding a fluid holding potable beverage container, the beverage container having flexible walls and an access port positioned on a top portion of the beverage container and through which the beverage is easily*

*expelled when pressure is applied to the flexible side walls, said receptacle comprising:*

*a plurality of rigid planar side walls each connected to an adjacent one of said side walls for resisting the pressure and thereby preventing the expelling of the beverage;*

*a bottom connected to at least one of said side walls, said side walls and said bottom collectively defining a box-like structure having an internal space therein, said structure having an opening for receiving the beverage container and said beverage container resting directly upon said bottom wall, and said bottom and said side walls combine to shield the flexible wall container from unwanted pressure exerted upon the flexible walls resulting in the expulsion of the beverage from the flexible wall container through the beverage container access port;*

*a top piece covering a portion of said opening and cooperating with said side walls to secure the beverage container within said internal space, wherein in a portion of said structure opening not covered by said top piece corresponds to the location of the access port of the beverage container when the beverage container is secured within said internal space and wherein said top piece comprises a substantially rectangular shaped cover having a first protuberance and a second protuberance, said first protuberance protruding from a first edge and said second protuberance protruding from a second and opposite edge; and a first aperture and a second aperture, said first aperture being located interiorly within said internal space and on a first of said planar sidewalls and said second aperture being located interiorly within said internal space and on a second and opposite one of said planar side walls, said first aperture being positioned to receive in mating fashion said first protuberance and said second aperture being positioned to receive in mating fashion said second protuberance.*

*29. The combination of claim 28 wherein said cover utilizes a snap closure to secure said cover in place on said receptacle when said first and said second protuberance and said first and said second aperture are arranged in mating fashion.*

*30. The combination of claim 29 wherein said first aperture and said second aperture are each grooves, and said first protuberance and said second protuberance slide in mating fashion within said respective grooves.*

*31. The combination of claim 30 wherein said first protuberance and said second protuberance are located on opposite edges of one end of said top piece, and said top piece includes a hinge located on an opposite end of said top piece, said hinge cooperating with one of said planar side walls.*

*32. The combination of claim 31 wherein said hinge comprises a pivot pin cooperating with a socket on one of said planar side walls.*

* * * * *